US008336147B2

(12) United States Patent
Knez

(10) Patent No.: US 8,336,147 B2
(45) Date of Patent: Dec. 25, 2012

(54) APPARATUS FOR CLEANING SPHERICAL OBJECTS

(76) Inventor: Jordan Knez, Halmstad (SE)

( * ) Notice: Subject to any disclaimer, the term of this patent is extended or adjusted under 35 U.S.C. 154(b) by 450 days.

(21) Appl. No.: 12/450,071

(22) PCT Filed: Mar. 3, 2008

(86) PCT No.: PCT/SE2008/000172

§ 371 (c)(1),
(2), (4) Date: Dec. 3, 2009

(87) PCT Pub. No.: WO2008/111890

PCT Pub. Date: Sep. 18, 2008

(65) Prior Publication Data

US 2010/0088831 A1 Apr. 15, 2010

(30) Foreign Application Priority Data

Mar. 14, 2007 (SE) ..... 0700639

(51) Int. Cl.
*A63B 47/04* (2006.01)

(52) U.S. Cl. ..... 15/21.2

(58) Field of Classification Search ..... 15/21.2
See application file for complete search history.

(56) References Cited

U.S. PATENT DOCUMENTS

| | | | | | |
|---|---|---|---|---|---|
| 409,754 | A | * | 8/1889 | Phelps | 15/3.16 |
| 3,654,655 | A | * | 4/1972 | Mitnick | 15/21.2 |
| 3,981,039 | A | * | 9/1976 | Rumph | 15/21.2 |
| 4,016,618 | A | * | 4/1977 | Kobayashi | 15/21.2 |
| 4,881,287 | A | | 11/1989 | Knez | |
| 5,819,351 | A | | 10/1998 | Porper | |

FOREIGN PATENT DOCUMENTS

| | | |
|---|---|---|
| JP | 2000-271252 | 10/2000 |
| SE | 468 787 | 3/1993 |

* cited by examiner

*Primary Examiner* — Randall Chin
(74) *Attorney, Agent, or Firm* — McGinn IP Law Group, PLLC

(57) ABSTRACT

An apparatus for cleaning (washing) spherical objects, preferably golf balls, includes two substantially round disks which are disposed in register with one another with an interspace which is less than the diameter of the spherical objects, at least the one disk being rotary and provided with a device for guiding the spherical objects out towards the periphery of the disk, and the second disk has a centrally located infeed opening and is provided with a brush which extends from the surface of the disk at an angle of less than 90° to the surface of the disk from the center of the disk out towards the periphery of the disk.

17 Claims, 4 Drawing Sheets

Fig 2
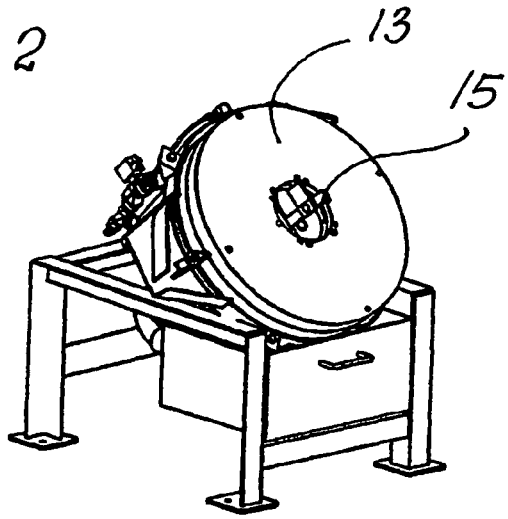
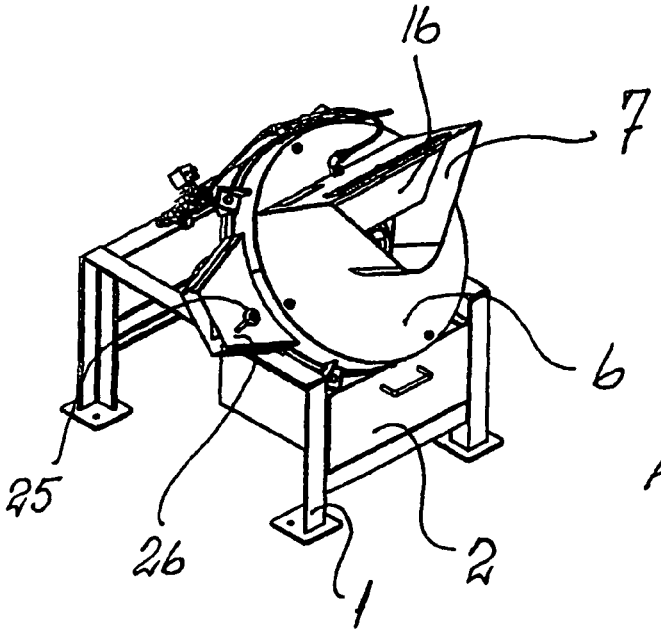
Fig 1

APPARATUS FOR CLEANING SPHERICAL OBJECTS

The present invention relates to an apparatus for cleaning and/or washing spherical objects.

In facilities for practicing driving golf balls, there are increasingly stringent requirements that the golf balls must be clean and at least give an overall impression of being more or less new. In such facilities, use is made of a very large number of golf balls, and the number of golf balls turned over per year can amount to as many as between ten and 15 million at one facility alone, and extremely high demands are placed on the capacity of the available ball washing or ball cleaning apparatuses. Prior art apparatuses suffer from limited capacity, and attempts to raise capacity have resulted in damage to the balls, which is unacceptable, since a damaged golf ball does not behave correctly after being driven.

The task forming the basis of the present invention is to improve and raise the capacity of known ball washing or ball cleaning apparatuses, without jeopardising the quality of the golf balls.

This task is solved according to the present invention in that the apparatus disclosed by way of introduction has been given the characterizing feature of the apparatus for cleaning and/or washing spherical objects.

The present invention realises an apparatus or arrangement for cleaning or washing golf balls with a very high capacity and extraordinarily high quality of the treated golf balls, which as a result are given considerably longer service life. This in turn results in a considerably improved operational economy in the practice facility.

The present invention will now be described in greater detail hereinbelow with reference to the accompanying Drawings.

FIG. 1 is a perspective view of an apparatus according to one embodiment of the present invention.

FIG. 2 is a perspective view of the apparatus according to FIG. 1, an upper portion having been removed.

Figure 3:
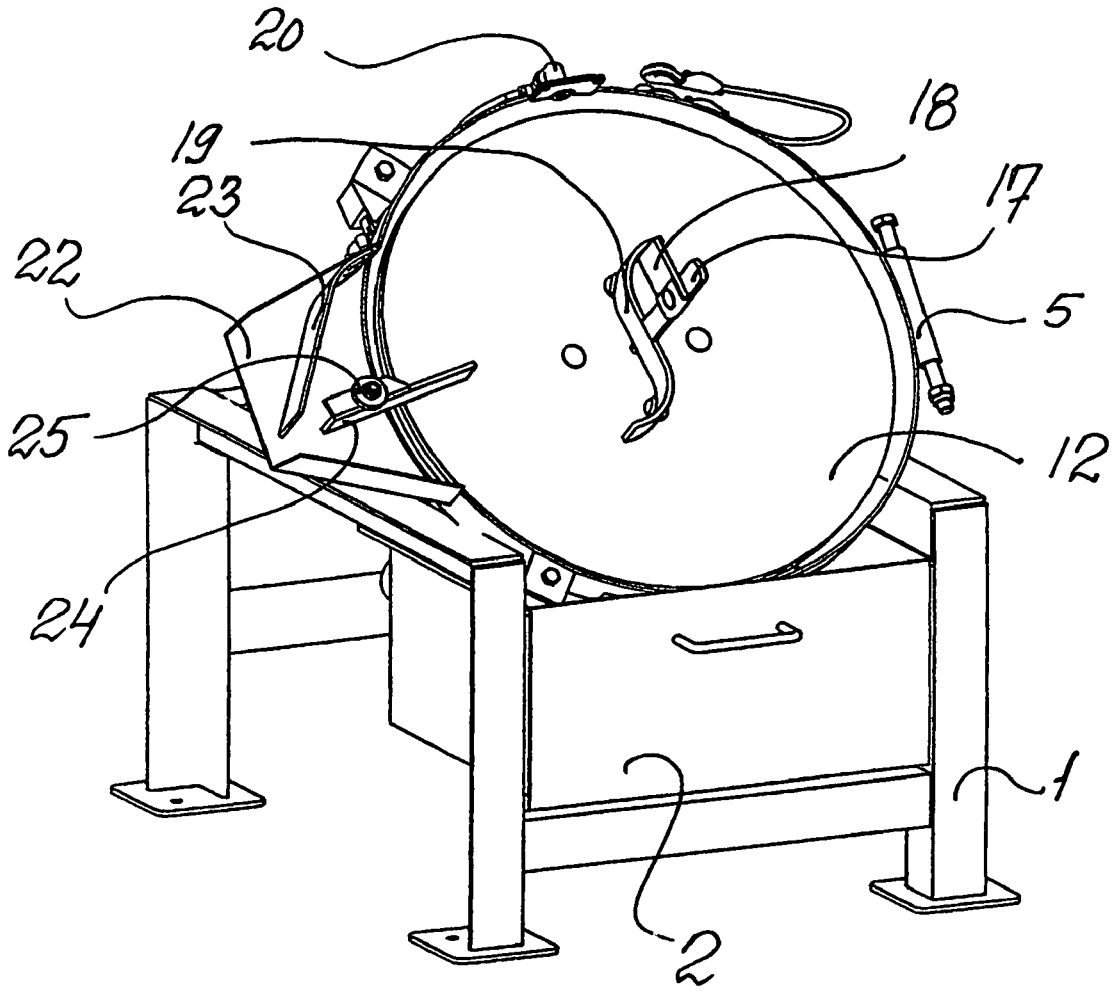
FIG. 3 is a view similar to that of FIG. 2, with a further portion removed.
Figure 4:
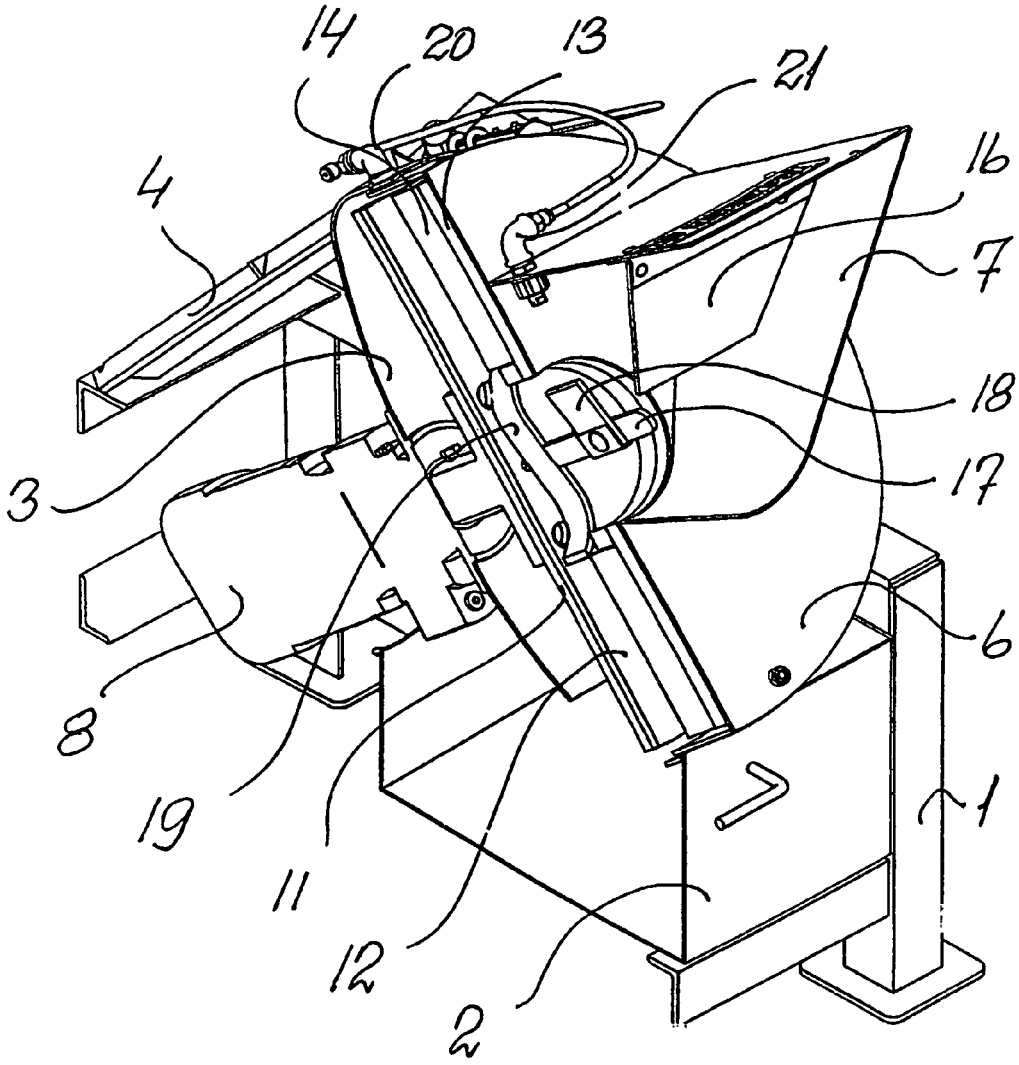
FIG. 4 is a view similar to that of FIG. 1, half of the apparatus having been removed approximately along the line A-A in FIG. 1.

The apparatus according to the present invention shown in. FIGS. 1 to 4 for cleaning or washing golf balls has a four-legged frame 1 with a receptacle box 2. The box 2 serves for collecting solid matter. In the frame 1 rests a substantially cup-shaped lower portion 3 which is secured in the slanting position with the aid of a stay 4. On the lower portion 3, an upper portion 6 is secured by means of a pivot or hinge 5. The upper portion 6 is provided with an infeed funnel 7 which may be disposed in a unit with the upper portion 6. A motor 8 is secured on the lower portion 3 and the output shaft of the motor extends into the lower portion 3. The shaft is provided with a mounting disk on which is fixedly mounted disk 11 which is circular and provided with a patterned coating 12. The motor 8 serves for rotation of the disk 11 counterclockwise seen in FIGS. 3 and 4. The coating 12 may suitably be of a rubber material with a suitable pattern. The pattern displays the mutually intersecting depressions or grooves which lead to the periphery of) the disk 11. The grooves or depressions in the coating 12 facilitate the removal of dirt from the coating. During rotation of the disk 11, the coating 12 will assist in the displacement (the rolling) of the golf balls in a helical or spiral pattern between the disks 11 and 13, or more correctly the coating 12 and the brush 14 whose slant in principle forces the golf balls out towards the periphery when the golf balls are rolling so that the entire circumferential surface of the golf balls is cleaned.

Figure 6:
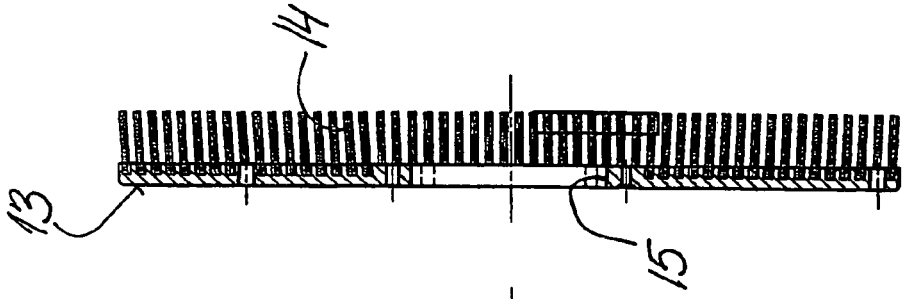
FIG. 6 is a section taken along the line A-A in FIG. 5.
Figure 5:
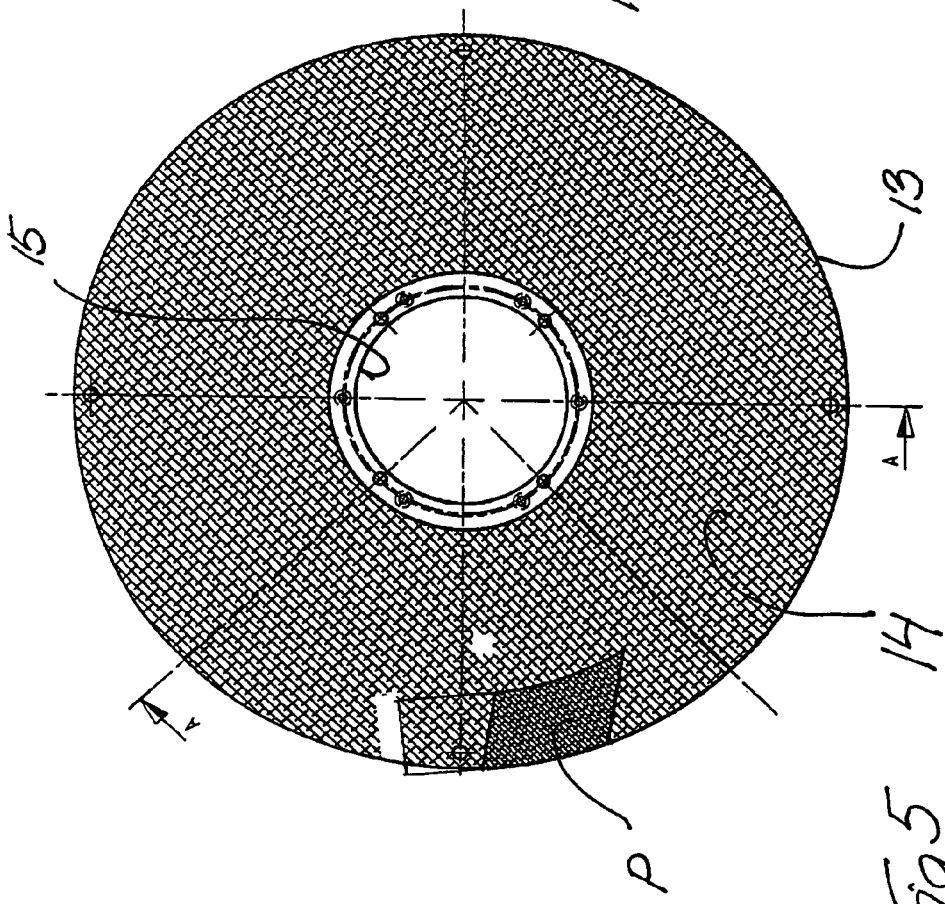
FIG. 5 is a top plan view of a part of the apparatus according to the present invention.

An additional disk 13 is disposed in the upper portion 6 and is provided with brash 14 which is illustrated more closely in FIGS. 5 and 6 and which is directed towards the coating 12 on the disk 11. The distance between the coating 12 of the disk 11 and the brush 14 of the disk 13 is less than the diameter of the golf balls. In one area P, the brush 14 is shorter than on the rest of the disk surface, so that, in this area P, the distance between the shorter brush and the coating 12 on the rotating disk 11 is equal to or greater than the diameter of the golf balls. The area P has the configuration shown in FIG. 5. The brush 14 is directed towards the periphery of the disk 13 and the bristles of the brush extend at an angle less than 90° to the surface of the disk 13 in a direction towards the central region of the disk 13. A suitable angle has been found to be 87° in one embodiment of the apparatus according to the invention.

It has proved that the slanting brush 14 results in the golf balls rolling in the direction of slant of the brush 14 while the coating 12 on the disk rolls the golf balls in the opposite direction, so that the golf balls are cleaned throughout their entire outer surface during their migration from the central region of the disk 13 out towards its periphery. This migration of the golf balls from the central region out to the periphery takes place under cooperation between the brush 14 on the disk 13 and the coating 12 on the disk 11.

The disk 13 has a central infeed opening 15. In the infeed funnel 7 which surrounds the central opening 15 in the disk 13, there is disposed a screen 16 for clamping the speed of falling golf balls and ensuring that they arrive in the infeed opening 15 in the disk 13.

In the centre of the disk 11, there is disposed a bar 17 which extends up through the infeed opening 15 and supports an arm 18 which rotates with the bar 17 and the disk 11 and displaces golf balls into the infeed opening 15 so that they more readily may enter into the space between the disk 11 and the disk 13. The bar 17 further supports an S-shaped arm 19 which is located at the surface of the coating 12 and rotates with the disk 11. The arm 19 displaces the golf balls from the central region of the disk 11 under the infeed opening 15 out towards the periphery of the disk 11 and into the space between the disks 11 and 13, whereafter the golf balls migrate substantially helically through the space out towards the periphery of the disks 11 and 13 and are processed during displacement in the space from the infeed opening 15 to the periphery of the disks 11, 13. The central portion of the arm 19 is shown in FIGS. 2 and 3 as straight, but may also be gently arcuate for as gentle a contact with the golf balls as possible.

It has proved that the golf balls rotate during the displacement from the infeed opening 15 to the periphery of the disks 11 and 13 so that their entire outer surface is processed and cleaned in an extremely efficient and gentle manner. On the lower portion 3, there is secured a nozzle 20 which discharges in the space between the disks 11 and 13 for supplying water therein. On the infeed funnel 7, there is also secured a nozzle 21 for supplying water therein and thereby for spraying the golf balls in and at the infeed opening 15 with water. The screen 16 will also direct water from the nozzle 21 towards the golf balls in and at the infeed opening. The screen 16 also prevents water from spraying at least straight out of the funnel 7. There may also be provided nozzles for the supply of a suitable cleaning agent.

The lower portion 3 is further provided with a discharge funnel 22. In such instance, it should be observed that half of the discharge funnel 22 is secured on the lower portion 3 while the other half of the discharge funnel 22 is secured on the upper portion 6.

In the discharge funnel 22, there is provided a deflector 23 for guiding the golf balls towards the lower region of the discharge funnel 22. In the discharge funnel 22, there is provided a further deflector 24 which may be fixed on the upper portion of the discharge funnel 22 by means of a pan head bolt 25 and is adjustable into and out of the space between the disks 11 and 13 for discontinuing the displacement of the golf balls in the space between the disks 11 and 13. The pan head bolt 25 extends through a groove 26 in that part of the discharge funnel 22 which is located on the upper portion 6, the pan head bolt 25 being displaceable along the groove 26 for adjusting the projection of the deflector 24 in the space between the disks 11 and 13. Thus, the deflector 24 is both pivotal and shiftable into and out of the space between the disks 11 and 13. On mounting of the disk 13, it is positioned so that the lower area P in the brush 14 is positioned in the proximity of, i.e. at or just ahead of the deflector 24, which may possibly extend in over the area P, so that the golf balls are not clamped or jammed between the brush 14 and the coating 12 when the golf balls are discharged out from the space between the brush 14 and the coating 12. This implies also that the golf balls strike the deflector 24 with less of an impact force. The size of the area P may be adapted to how far the deflector 24 extends into the space between the disks 11 and 13. The width of the deflector 24 is less than the distance between the brush 14 on the disk 13 and the coating 12 on the disk 11.

In one prototype, the thickness of the brush disk 13 is 15 mm and its diameter is 470 cm, the diameter of the infeed opening is 130 mm, the area P has the approximate dimensions: length 70 mm, width 50 mm and depth 13 mm, while the height of the brush 14 is 35 mm. The brush 14 consists of approximately 110-116 bristles or fibres in each hole, which is 10 mm deep and has a diameter of 6 mm, the centre spacing between the holes being 9 mm in all directions. The brush disk 13 has a thickness of 15 mm and is fixed in the upper portion 6 by means of bolts.

Many modifications are naturally possible without departing from the scope of the inventive concept as defined in the appended Claims.

The invention claimed is:

1. An apparatus for cleaning and/or washing spherical objects, said apparatus comprising:

two substantially round disks, which are disposed in register with one another, with an interspace which is less than a diameter of the spherical objects, wherein at least one disk of the two substantially round disks is rotary and provided with means for guiding the spherical objects out towards a periphery of the one disk, and a second disk of the two substantially round disks comprises a centrally located infeed opening and is provided with a brush extending from a surface of the second disk at an angle of less than 90° with respect to the surface of the second disk from a center of the second disk out towards a periphery of the second disk.

2. The apparatus as claimed in claim 1, wherein said guiding means on the one disk comprises a substantially S-shaped arm which is secured on a central bar and which extends out on sides of the bar.

3. The apparatus as claimed in claim 1, wherein a bar extends through the infeed opening in the second disk and supports an arm for acting on the infeed opening and/or the spherical objects located outside the opening.

4. The apparatus as claimed in claim 3, wherein the infeed opening is surrounded by an infeed funnel for inward guiding of the spherical objects into the infeed opening.

5. The apparatus as claimed in claim 1, wherein a discharge funnel is disposed at the peripheries of the two substantially round disks for receiving the spherical objects which have been displaced between the two substantially round disks from their central region to their peripheries and the discharge funnel for further displacement to a receptacle of washed spherical objects.

6. The apparatus as claimed in claim 1, wherein at least one water nozzle discharges in the interspace between the two substantially round disks and/or at least one water nozzle discharges above the infeed opening in the second disk.

7. The apparatus as claimed in claim 1, wherein the guiding means on the one disk comprises a surface coating which guides the spherical objects out towards the peripheries of the disks.

8. The apparatus as claimed in claim 1, wherein the brush on the second disk guides the spherical objects out towards the peripheries of the disks.

9. The apparatus as claimed in claim 1, further comprising:

a discharge funnel disposed at the peripheries of the two substantially round disks, wherein the discharge funnel comprises a deflector for guiding the spherical objects towards an edge in the discharge funnel.

10. The apparatus as claimed in claim 1, further comprising:

a discharge funnel disposed at the peripheries of the two substantially round disks, wherein the discharge funnel comprises a deflector which is disposed to extend into the interspace between the disks and to guide out the spherical objects in the discharge funnel.

11. The apparatus as claimed in claim 10, wherein the deflector is adjustable for adjusting a distance that the defector extends between the two substantially round disks.

12. The apparatus as claimed in claim 1, wherein bristles of the brush extend at an angle less than 90° to the surface of the second disk.

13. The apparatus as claimed in claim 12, wherein the bristles of the brush extend at 87° to the surface of the second disk.

14. An apparatus for cleaning and/or washing spherical objects, said apparatus comprising:

two substantially round disks, which are disposed in register with one another, with an interspace which is less than a diameter of the spherical objects, wherein at least one disk of the two substantially round disks is rotary and provided with means for guiding the spherical objects out towards a periphery of the one disk, and a second disk of the two substantially round disks comprises a centrally located infeed opening and is provided with a brush extending from a surface of the second disk at an angle of less than 90° with respect to the surface of the second disk from a center of the second disk out towards a periphery of the second disk, and wherein the guiding means on the one disk includes a surface coating which, together with the brush on the second disk, guides the spherical objects out towards the peripheries of the disks.

15. An apparatus for cleaning and/or washing spherical objects, said apparatus comprising:

two substantially round disks, which are disposed in register with one another, with an interspace which is less than a diameter of the spherical objects, wherein at least one disk of the two substantially round disks is rotary and provided with means for guiding the spherical objects out towards a periphery of the one disk, and a second disk of the two substantially round disks comprises a centrally located infeed opening and is provided with a brush extending from a surface of the second disk at an angle of less than 90° with respect to the surface of the second disk from a center of the second disk out towards a periphery of the second disk, wherein a discharge funnel is disposed at the peripheries of the two substantially round disks for receiving the spherical objects which have been displaced between the two substantially round disks from their central region to their peripheries and the discharge funnel for further displacement to a receptacle of washed spherical objects, and wherein the discharge funnel is provided with a first deflector for guiding the spherical objects towards an edge in the discharge funnel.

16. The apparatus as claimed in claim 15, wherein the discharge funnel is further provided with a second deflector which is disposed to extend into the interspace between the disks and to guide out the spherical objects in the discharge funnel.

17. The apparatus as claimed in claim 16, wherein the second deflector is adjustable for adjusting a distance that the second defector extends between the two substantially round disks.

* * * * *